US006341964B1

(12) United States Patent
Yu

(10) Patent No.: US 6,341,964 B1
(45) Date of Patent: Jan. 29, 2002

(54) MEMORY CARD CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,288

(22) Filed: Dec. 28, 2000

(30) Foreign Application Priority Data

Nov. 17, 2000 (TW) ..... 089219991

(51) Int. Cl.[7] ..... H01R 12/00
(52) U.S. Cl. ..... 439/79; 439/541.5
(58) Field of Search ..... 439/79, 80, 541.5, 439/701

(56) References Cited

U.S. PATENT DOCUMENTS 5,601,438 A * 2/1997 Ho et al. ..... 439/64
5,709,568 A * 1/1998 Pan et al. ..... 439/541.5
5,967,831 A * 10/1999 Yamada et al. ..... 439/496

* cited by examiner

*Primary Examiner*—Khiem Nguyen
(74) *Attorney, Agent, or Firm*—Wei Te Chung

(57) ABSTRACT

A memory card connector (10) of the present invention includes a dielectric header (16) and a number of contacts (18) retained in the header. The header has a base portion (20) and two guiding arms (22) extending from a face (24) of the base portion. The base portion forms a tongue portion (30) extending from an opposite face (32) thereof. A number of contact receiving cavities (34) are defined through said opposite faces of the base portion and along the tongue portion. Each contact has a mating portion (44) and an engaging portion (46) positioned at different heights. The mating portions extend through the cavities of the base portion and the engaging portions are fixedly and protectively received in the cavities of the tongue portion.

18 Claims, 3 Drawing Sheets

MEMORY CARD CONNECTOR

BACKGROUND OF THE INVENTION

1. Field of the Invention

The present invention relates to a connector, and particularly to a memory card connector adapted for connecting one or more memory cards to a printed circuit board (PCB).

2. Prior Art

In the personal computer (PC) field, memory cards are usually connected to a printed circuit board (PCB) by one or more memory card connectors. Some of these memory cards must comply with a standard defined by the Personal Computer Memory Card International Association (PCMCIA), and such connectors are called PCMCIA connectors, or card bus connectors.

U.S. Pat. No. 5,711,679 ('679) discloses one type of PCMCIA connector. The connector includes a dielectric header and a number of contacts retained in a portion of the dielectric header. Two opposite ends of each contact extend beyond opposite faces of the dielectric header. One of the ends of each contact, called the mating end, is adapted for mating with a terminal of an inserted memory card, and the other, called the mounting end, is adapted for being mounted to the PCB by SMT or through-hole technology. However, since the mounting ends of the contacts are supported by the dielectric header, the mounting ends may become bent so that they cannot be properly mounted to solder pads on the PCB.

The '679 patent also discloses an alternate PCMCIA connector whose contacts are first electrically mounted to a daughter card and the daughter card is then inserted into an edge card connector that is mounted on a PCB. However, the daughter card is relatively expensive, and mounting the contacts to the daughter card is troublesome.

U.S. Pat. No. 5,636,999 discloses another alternate PCMCIA connector. The connector includes a dielectric insert located adjacent mounting ends of contacts of the connector. Although the connector solves the above bending problem, it requires the insert. Hence, an improved electrical connector is desired to overcome the disadvantages of the prior art.

SUMMARY OF THE INVENTION

A first object of the present invention is to provide a memory card connector having contact supporting means for properly supporting or arranging mounting portions of contacts using the contact supporting means;

A second object of the present invention is to provide an assembly of the memory card connector, an adapter engageable with the memory card connector and a printed circuit board (PCB) on which the memory card connector and the adapter are mounted.

To obtain the above objects, a memory card connector of the present invention includes a dielectric header and a number of contacts retained in the header. The header has a base portion and two guiding arms extending from a face of the base portion. The base portion forms a tongue portion extending from an opposite face thereof. A number of contact receiving cavities are defined through said opposite faces of the base portion and along the tongue portion. Each contact has a mating portion and an engaging portion positioned at different heights. The mating portions extend through the cavities of the base portion and the engaging portions are fixedly and protectively received in the cavities of the tongue portion.

Other objects, advantages and novel features of the invention will become more apparent from the following detailed description of the present embodiment when taken in conjunction with the accompanying drawings.

DETAILED DESCRIPTION OF THE INVENTION

Figure 1:
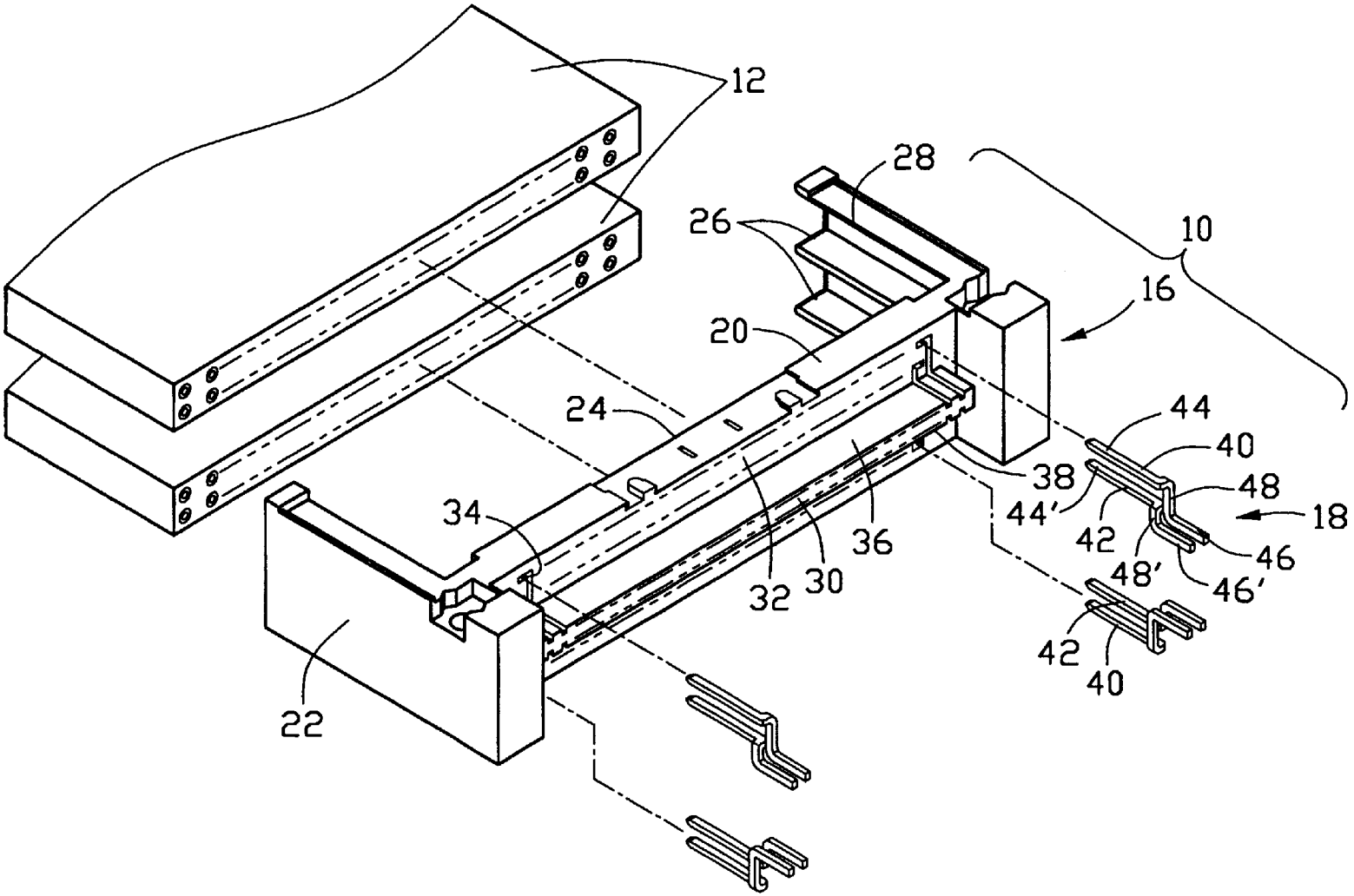
FIG. 1 is an exploded perspective view of a predigested memory card connector in accordance with the present invention and two memory cards before insertion into the memory card connector.

Referring to FIG. 1, a memory card connector, and in particular, a card bus connector, of the present invention is illustrated. The memory card connector 10 is configured for connecting one or more memory cards 12 to a printed circuit board (PCB) 14 (shown in FIG. 3). The memory card connector 10 comprises a dielectric header 16 and a plurality of contacts 18 retained in the header 16. The header 16 includes a base portion 20 and a pair of arms 22 extending parallel to one another from a first face 24 of the base portion 20. Each arm 22 defines two guiding slots 26 in an inner face 28 thereof for facilitating insertion of the one or more memory cards 12 into the header 16. The base portion 20 forms a tongue portion 30 extending from a second face 32 opposite the first face 24 thereof. The tongue portion 30 is generally positioned at a height between the two guiding slots 26. The base portion 20 defines a plurality of contact receiving cavities 34 through the first and the second faces 24, 32 thereof and the cavities 34 further extend along the second face 32 and along a top and a bottom faces 36, 38 of the tongue portion 30.

The contacts 18 include first contacts 40 and second contacts 42. Each first contact 40 has a mating portion 44 for mating with the memory card 12, an engaging portion 46 and a connecting portion 48 between the mating portion 44 and the engaging portion 46. Similarly, each second contact 42 has a mating portion 44', an engaging portion 46' and a connecting portion 48'. The connecting portion 48 laterally extends from an end of the mating portion 44 and then downwardly extends a distance and then forwardly extends to form the engaging portion 46, which is generally parallel to the mating portion 44. The second contact 42 is a mirror image of the first contact 40 except that the second contact 42 extends laterally and downwardly a smaller distance than does the first contact 40.

In assembly, the contacts 18 are inserted into the cavities 34 of the base portion 20 with the mating portions 44 extending through the first face 24 of the base portion 20 and the connecting portions 48 and the engaging portions 46 being fixedly and protectively retained respectively in the cavities 34 of the second face 32 and the tongue portion 30. The engaging portions 46 are exposed at respective top and bottom faces 36, 38 of the tongue portion 30 for electrical engagement with complementary terminals as detailed below. The mating portions 44 and the engaging portions 46 of the contacts 18 are positioned at different heights. The first contacts 40 and the second contacts 42 are alternately received in the cavities 34 of the tongue portion 30. The mating portions of pairs of the adjacent first and second contacts 40, 42 laterally offset toward each other half a pitch of engaging portions of the first and second contacts 40, 42 and are arranged in outer and inner rows relative to the tongue portion 30. The engaging portions of adjacent first and second contacts 40, 42 are arranged side by side with no offset. Therefore, the pitch of the mating portions of the first and second contacts 40, 42 is double the pitch of the engaging portions of the first and second contacts 40, 42. The mating portion 44 and the engaging portion 46 of the same contact 18 have different cross-sectional dimensions.

Figure 2:
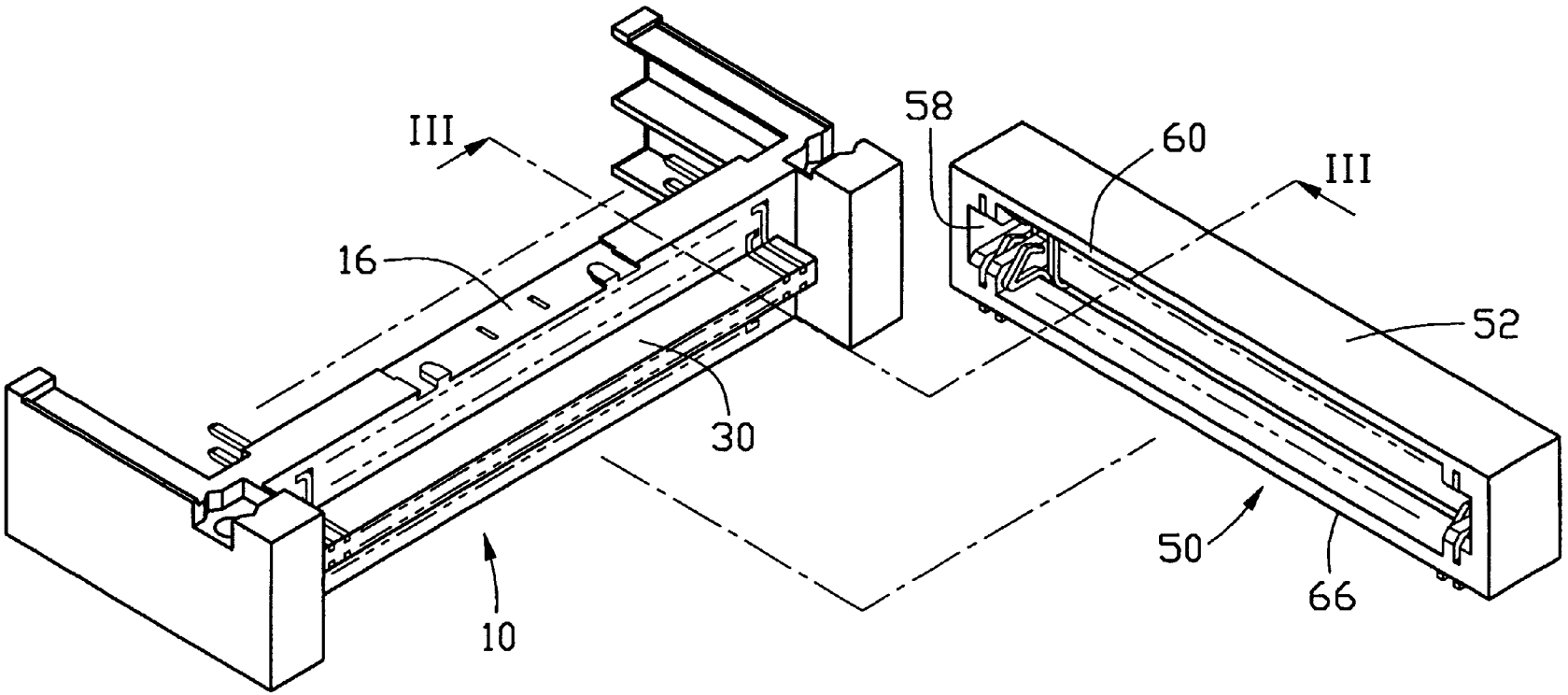
FIG. 2 is a perspective view of the assembled memory card connector of FIG. 1 and an adapter before mating with the memory card connector.
Figure 3:
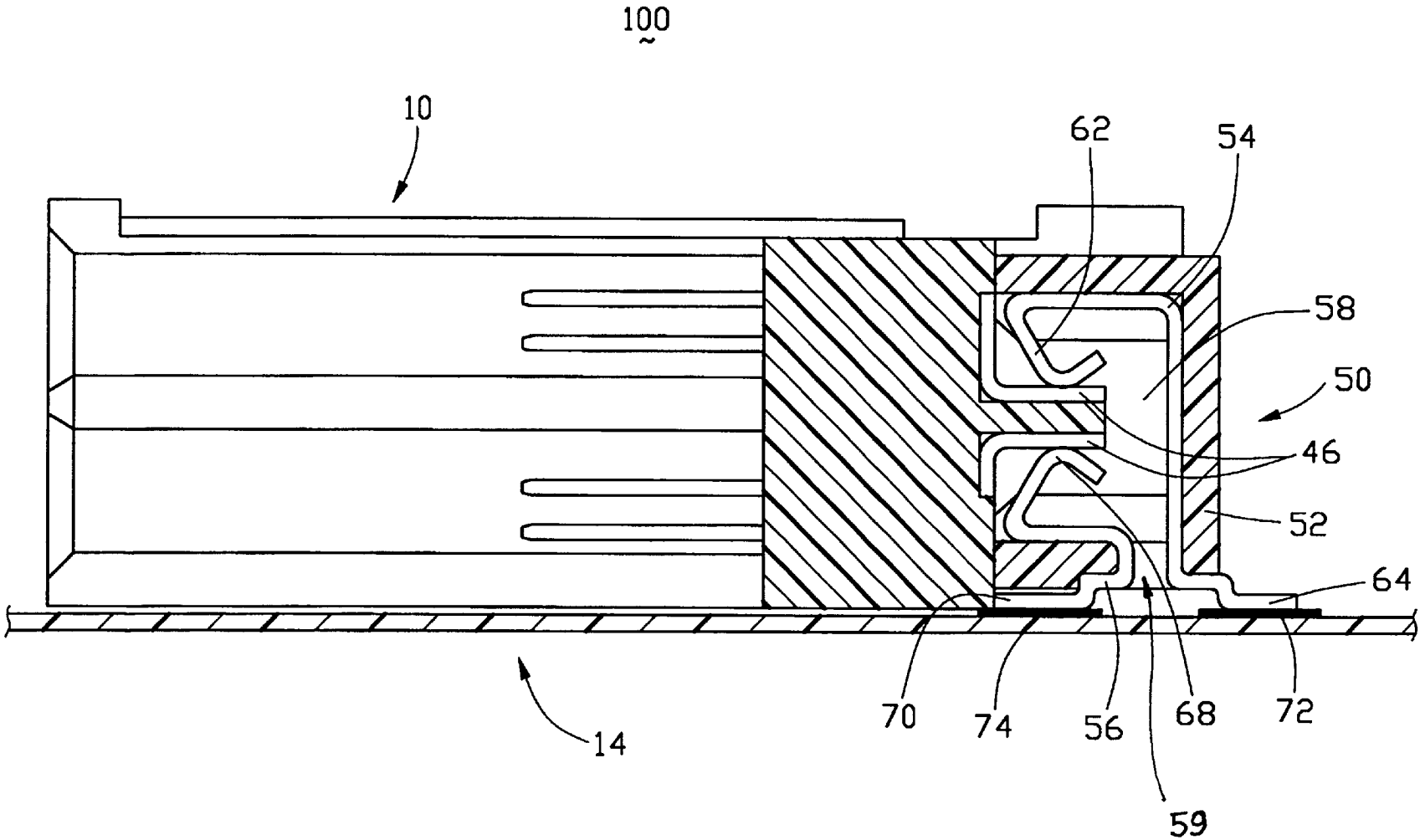
FIG. 3 is a cross-sectional view of an assembly of the memory card connector, the adapter and a printed circuit board on which the memory card connector and the adapter are mounted, taken along line III—III of FIG. 2.

FIGS. 2 & 3 show an electronic assembly 100 consisting of the memory card connector 10, an adapter 50 mated with the memory card connector 10 and the PCB 14 on which the memory card connector 10 and the adapter 50 are mounted is shown. The adapter 50 includes a dielectric housing 52 and a row of upper terminals 54 and a row of lower terminals 56 received in the housing 52. The housing 52 defines a slit 58 in a side face 60 thereof. Each upper terminal 54 has a contacting portion 62 extending into the slit 58 and a mounting portion 64 extending through the opening 59 around the bottom/rear portion of the housing 52 and beyond a bottom face 66 of the housing 52. Each lower terminal 56 has a contacting portion 68 extending into the slit 58 and a mounting portion 70 extending beyond the bottom face 66 of the housing 52. The mounting portions 64, 70 of the terminals 54, 56 electrically connect to corresponding solder pads 72, 74 of the PCB 14. The tongue portion 30 of the header 16 is received in the slit 58 of the housing 52 and the engaging portions 46 of the contacts 18 electrically contact corresponding contacting portions 62, 68 of the terminals 54, 56.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A memory card connector for connecting one or more memory cards to a printed circuit board, comprising:

a dielectric header, including a base portion and a pair of arms generally extending parallel to one another from a first face of the base portion, each arm defining at least a guiding slot in an inner face thereof for facilitating insertion of the one or more memory cards into the header, the base portion having a tongue portion extending from a second face opposite the first face thereof, the header having a plurality of contact receiving cavities each including a first cavity section defined through the base portion and a second cavity section defined in the tongue portion; and a plurality of contacts received in the cavities of the header, each contact having a mating portion and an engaging portion respectively extending beyond the first and the second faces of the base portion, the whole engaging portions being parallelly and protectively received in the second cavity sections in the tongue portion.

2. The memory card connector as claimed in claim 1, wherein the mating portions and the engaging portions of the contacts are positioned at different heights.

3. The memory card connector as claimed in claim 2, wherein the mating portion and the engaging portion of the same contact have different cross-sectional dimensions.

4. The memory card connector as claimed in claim 1, wherein the plurality of contacts comprises pairs of adjacent first contacts and second contacts and the mating portions of pairs of adjacent first and second contacts laterally offset toward each other half a pitch of the first engaging portions of the and second contacts and are arranged in outer and inner rows relative to the tongue portion.

5. The memory card connector as claimed in claim 4, wherein the pitch of the mating portions of the first and second contacts is double the pitch of the engaging portions of the first and second contacts.

6. The memory card connector as claimed in claim 1, wherein each arm of the header defines two guiding slots in the inner face thereof and the tongue portion is position at a height between the two guiding slots, and the engaging portions of the contacts are arranged in top and bottom faces of the tongue portion.

7. An electronic assembly comprising:

a dielectric header, including a base portion and a pair of arms generally extending parallel to one another from a first face of the base portion, each arm defining at least a guiding slot in an inner face thereof for facilitating insertion of one or more memory cards into the header, the base portion having a tongue portion extending from a second face opposite the first face thereof, a plurality of contact receiving cavities being defined through the base portion and along the tongue portion;

a plurality of contacts received in the cavities of the base portion, each contact having a mating portion and an engaging portion respectively extending beyond the first and the second faces of the base portion, the engaging portions being fixedly and protectively received in the cavities of the tongue portion;

a dielectric housing receiving a plurality of terminals therein and defining a slit in a side face thereof, each terminal having a contacting portion extending into the slit and a mounting portion extending beyond a bottom face of the housing, the tongue portion of the header being received in the slit of the housing and the engaging portions of the contacts electrically contacting corresponding contacting portions of the terminals; and a printed circuit board (PCB) having a plurality of solder pads thereon, the header and the housing being positioned on the PCB and the mounting portions of the terminals electrically connecting to corresponding solder pads.

8. The electronic assembly as claimed in claim 7, wherein the mating portions and the engaging portions of the contacts are positioned at different heights.

9. The electronic assembly as claimed in claim 7, wherein the mating portion and the engaging portion of the same contact have different cross-sectional dimensions.

10. The electronic assembly as claimed in claim 7, wherein the plurality of contacts comprises pairs of adjacent first contacts and second contacts and the mating portions of the pairs of adjacent first and second contacts laterally offset toward each other half a pitch of the engaging portions of the first and second contacts and are arranged in outer and inner rows relative to the tongue portion.

11. The electronic assembly as claimed in claim 10, wherein the pitch of the mating portions of the first and second contacts is double the pitch of the engaging portions of the first and second contacts.

12. The electronic assembly as claimed in claim 7, wherein the engaging portions of the contacts are arranged in top and bottom faces of the tongue portion and the contacting portions of the terminals are arranged in an upper and a lower rows to contact corresponding engaging portions of the contacts.

13. An electrical assembly comprising:

a dual-port memory card connector including a header with a pair of arms defining two guiding slots therein for receiving upper and lower memory cards therein;

two rows of upper contacts disposed in the header corresponding to the upper memory card with engaging portions exposed to a rear face of the header;

two rows of lower contacts disposed in the header corresponding to the lower memory card with engaging portions exposed to the rear face of the header;

a tongue portion extending rearward from the rear face of the header, said tongue portion defining thereof top and bottom faces respectively receiving the engaging portions of the upper contacts and those of the lower contacts therein; and an adaptor positioned behind the memory card connector, said adaptor including a dielectric housing defining a slit with a row of upper terminals and a row of lower terminals located by two sides thereof; wherein the tongue member is received within the slit with the upper terminals engaging the upper contacts and the lower terminals engaging the lower contacts.

14. The assembly as claimed in claim 13, wherein said tongue member is positioned at a mid-height of said housing.

15. The assembly as claimed in claim 13, wherein both the memory card connector and the adaptor are seated on a printed circuit board.

16. An adaptor for use with a dual-port memory card connector, comprising:

an insulative housing defining a horizontal slit therein;

an opening formed around a bottom/rear portion of the housing;

one row of upper terminals and one row of lower terminals located by two sides of the slit;

each of said upper terminals and said lower terminals including a contacting portion extending into the slit, and a mounting portion extending downwardly through the opening; wherein the mounting portion of the upper terminal is further horizontally and rearwardly bent to extend beyond a rear face of the housing, while the mounting portion of the lower terminal is further horizontally and forwardly bent to extend under a bottom face of the housing.

17. A memory card connector for connecting one or more memory cards to a printed circuit board, comprising:

a dielectric header including a base portion and a pair of arms forwardly extending from a front face of the base portion, the base portion having a tongue portion extending from a rear face thereof and a plurality of contact receiving cavities defined in a top surface and a bottom surface of the tongue portion; and a plurality of contacts received in the cavities of the dielectric header, each contact having a mating portion and an engaging portion respectively extending beyond the front and the rear faces of the base portion, the engaging portions being fixedly and protectively resided in the cavities in the top and the bottom surfaces of the tongue portion and each having a side surface unshrouded by the tongue portion.

18. The memory card connector as claimed in claim 17, wherein the engaging portions of the contacts are parallel with the top surface of the tongue portion of the header.

* * * * *